United States Patent [19]

Wall

[11] 3,935,870

[45] Feb. 3, 1976

[54] GUIDE MEANS FOR CUTTING HAIR

[76] Inventor: Albert Wall, 515 S. Crescent Ave., Lodi, Calif. 95240

[22] Filed: Aug. 7, 1974

[21] Appl. No.: 495,422

[52] U.S. Cl. ..... 132/45 R
[51] Int. Cl.[2] ..... A45D 24/36
[58] Field of Search ..... 132/45 R, 9

[56] References Cited

UNITED STATES PATENTS

| | | | |
|---|---|---|---|
| 416,489 | 12/1889 | Parrish | 132/9 |
| 2,808,840 | 10/1957 | De Santis | 132/45 R |
| 3,202,158 | 8/1965 | Dumont | 132/45 R |

*Primary Examiner*—G. E. McNeill
*Attorney, Agent, or Firm*—Flehr, Hohbach, Test, Albritton & Herbert

[57] ABSTRACT

A template device for use in evenly cutting long hair on opposite sides of a substantially vertical centerline is supported from the neck or shoulders and includes on the exposed backside thereof fine radially extending grooves serving to capture the contiguous layer of hair laid thereon, the depth of the grooves sufficient to restrain the strands of the contiguous layer of hair lying thereon from easily moving away from the barber's shears as the tips of the shears are guided along a predetermined pattern of hair length formed on the surface of the back panel of the template.

Means in the form of shoulder straps or in the form of a specially configured template member serve to orient to a vertical position a centerline defined on the exposed part of the back panel of the template.

6 Claims, 14 Drawing Figures

FIG_1
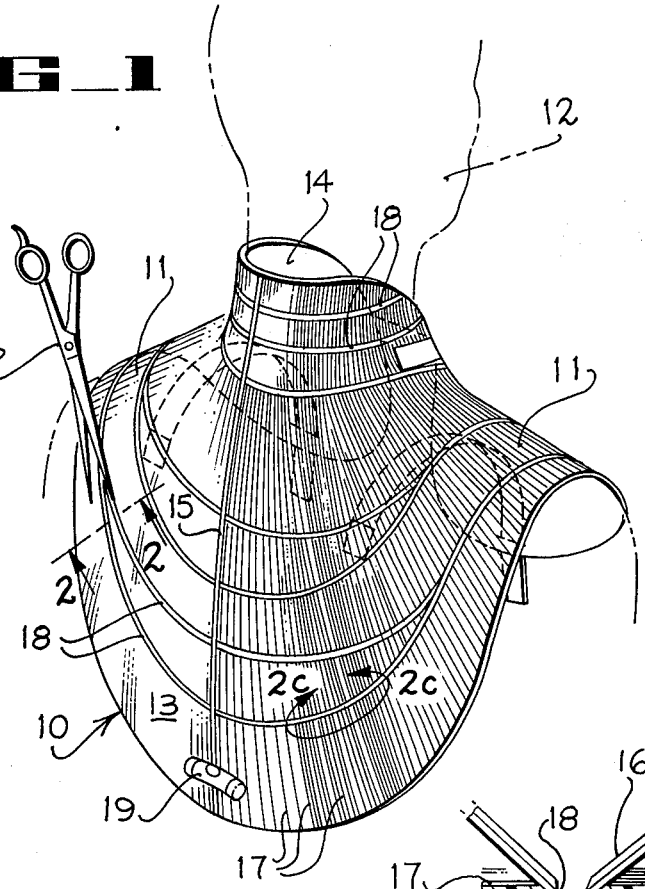
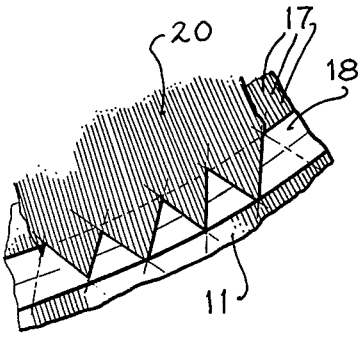
FIG_2D
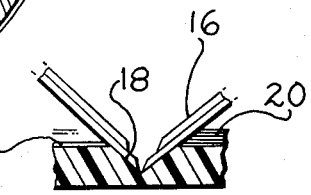
FIG_2
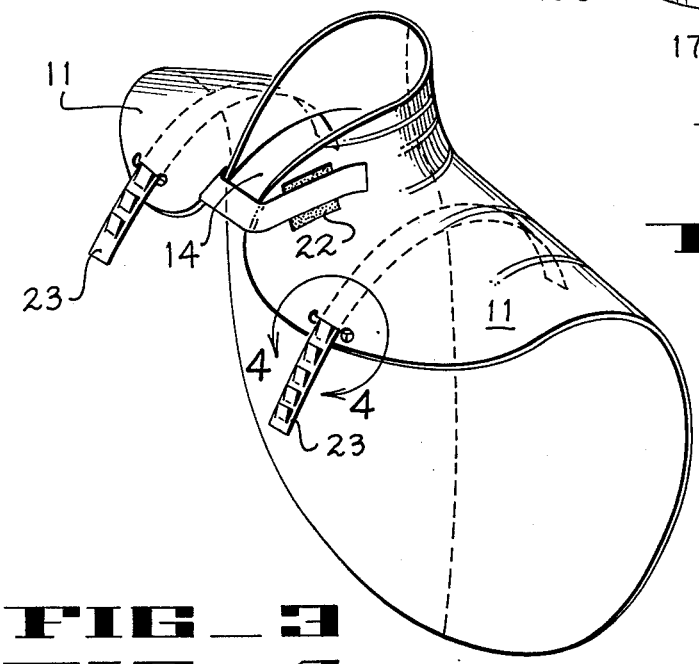
FIG_3
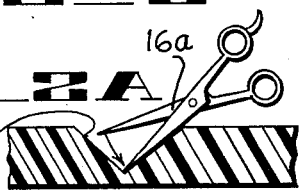
FIG_2A
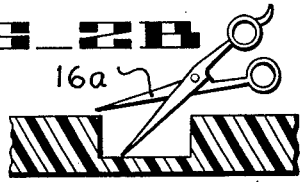
FIG_2B
FIG_4
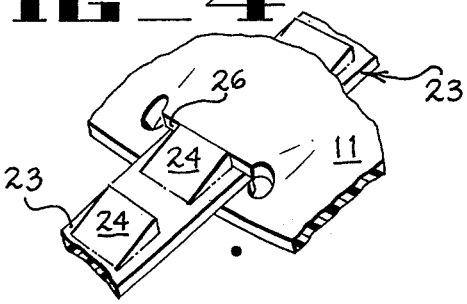
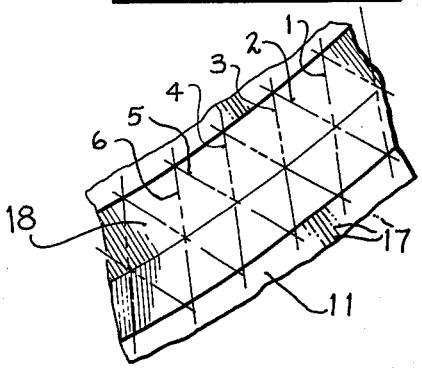
FIG_2C

GUIDE MEANS FOR CUTTING HAIR

BACKGROUND OF THE INVENTION

This invention pertains to devices serving as a guide for cutting hair, and more particularly to means for accurately shaping relatively long hair to selected contours and/or lengths.

In cutting long hair to a given contour, one of the main problems has been to obtain a balanced appearance so that the same amount of hair is disposed on each side of a vertical centerline lying generally along a person's backbone.

SUMMARY OF THE INVENTION AND OBJECTS

In general, a device for use in cutting long hair to an even length on opposite sides of a substantially vertical centerline defined to extend downwardly between the shoulders of a person comprising a template of semi-rigid material formed to provide a broad surface including shoulder portions adapted to be draped over the shoulders and back panel portion adapted to extend across the back of a person. The template further includes an open collar portion adapted to be yieldingly spread apart and disposed about the neck of the person, the shoulder portions and the back panel portion merging with the collar portion all as a substantially continuous surface.

Further, a sufficient number of fine grooves formed in the outer exposed surface of the back panel extend downwardly and laterally away from both sides of the centerline. A sufficient number of the fine grooves is provided so as to capture and retain the contiguous layer of hair laid thereagainst. The depth of the grooves is sufficient to restrain the strands of hair in the contiguous layer from readily moving ahead of the tips of the shears. Finally, a predetermined pattern of hair length is defined on the surface of the back panel for guiding tips of scissors of the barber in cutting the hair to conform to the predetermined pattern.

According to the preferred embodiments described further below, various advantageous features of the foregoing hair-cutting guide will be pointed out.

In general, it is an object of the present invention to provide an improved hair-cutting guide device in which a vertical centerline is reliably positioned upon the person whose hair is being cut.

Another object of the invention is to provide a hair-cutting guide template whereby the tips of the barber's scissors can be guided by a groove in a manner to permit the tips to be successively disposed first at one angle and then at another so as to serrate the terminal ends of the hair as it is being cut.

Yet another object of the present invention is to provide a hair-cutting guide in which the hair of the contiguous layer thereof is restrained from lateral movement by engagement of the strands thereof with generally radially downwardly and laterally outwardly extending fine grooves formed in the surface of the template so as to make cutting the hair easier and simpler.

The foregoing and other objects and features of the invention will become more readily evident from the following detailed description of preferred embodiments thereof when considered in conjunction with the drawings.

BRIEF DESCRIPTION OF THE DRAWINGS

FIG. 1 shows a perspective diagrammatic view of a hair-cutting construction, according to the invention;

FIG. 2 shows an enlarged detail view taken along the line 2—2 of FIG. 1;

FIGS. 2A — 2D show diagrams useful in explanation of aspects of the invention;

FIG. 3 shows a schematic perspective front view of a hair-cutting guide construction, according to the invention;

FIG. 4 shows an enlarged schematic detail taken in the region of the line 4—4 of FIG. 3;

FIG. 5 shows a front elevation view of the device as worn by a person having one shoulder lower than the other, according to the invention;

DETAILED DESCRIPTION OF PREFERRED EMBODIMENTS

Figure 6:
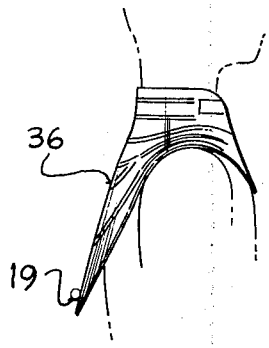
FIG. 6 shows a side elevation of FIG. 5.
Figure 9:
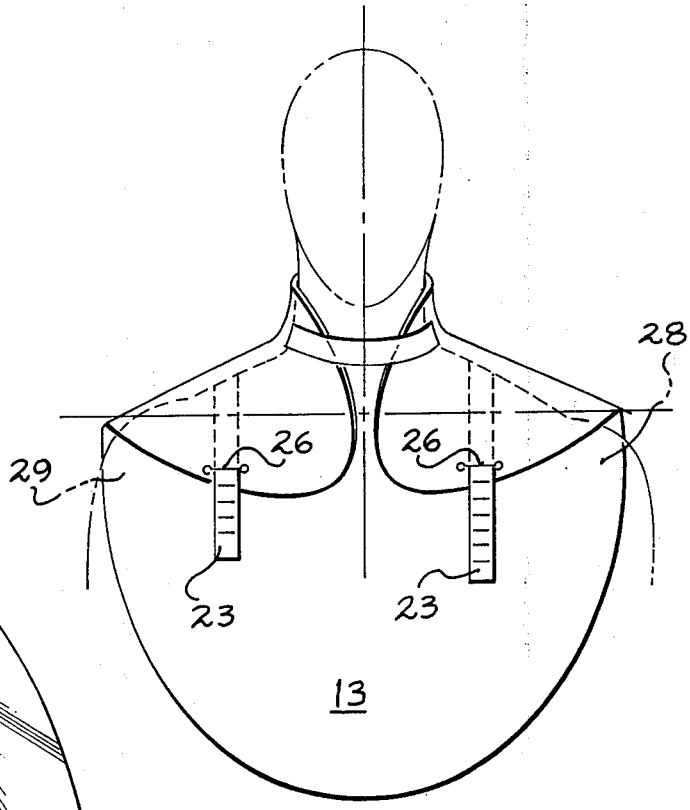
FIG. 9 shows a side elevation view of the embodiment shown in FIG. 7.

As shown in FIGS. 1 and 3, a device for use in cutting long hair and shaping the tail ends thereof to an even length on opposite sides of a substantially vertical centerline defined to extend downwardly between the shoulders of a person whose hair is being cut includes a template construction 10 of semi-rigid material such as plastic formed to provide a broad continuous surface including shoulder portions 11 adapted to be draped over the shoulders of the person 12 whose hair is being cut and a back panel portion 13 adapted to extend across the back of the person 12.

Template 10 includes an open collar portion 14 adapted to be yieldingly spread apart and disposed about the neck of the person 12.

Means serving to assist the spreading movement of the open collar portion 14 includes a line of weakness formed by a groove 15 extending vertically along the back panel 13 downwardly from collar portion 14 to the lower edge of template 10. Accordingly, line of weakness 15 serves to act something as a hinge and more readily permits the side parts of collar portion 14 to be spread apart for placing template assembly 10 onto the person receiving the hair cut.

Means serving to at least partially capture the strands of the contiguous layer of hair 20 laid against the exposed outer surface of panel 13 includes the number of fine grooves 17. Grooves 17 are relatively closely spaced and uniformly distributed to extend downwardly and laterally away from both sides of centerline 15. Grooves 17 restrain the hairs held therein from the shears 16. Thus, the contiguous layer of hair 20 is inhibited from lateral movement across template 10.

Preferably grooves 17 have a depth on the order of the radius of a human hair so as to capture the hair.

In the foregoing captured condition and being relatively immobile laterally on the surface of template 10, the tips of a barber's shears 16 can readily follow one of several grooves 18 defining a predetermined pattern of hair length defined on the surface of back panel 13.

The predetermined pattern as thus described is defined by a V-shaped groove of sufficient depth and width to permit the tips of barber's shears to cut hair lying across groove 18 while the shears lie against either side wall of groove 18. Accordingly, alternate snips of the scissors may be made successively from opposite sides of groove 18 so as to provide a fared edge to the ends of the hair being cut.

Further, formation of grooves 18 with a V-shaped cross-section allows the barber sufficient flexibility to be able to obtain a serrated cut along the bottom edge of the contour of the hair as now to be explained.

Initially, the barber will make a blunt cut merely following the groove and chopping off the excess hair as the tips of the shears follow a predetermined groove from one end to the other. Cutting of the hair in this manner, however, leaves it relatively unattractive, and it is usually considered desirable to serrate the edge of the hair cut. Accordingly, by use of a groove 18 as shown in FIG. 2A, the tip of the top blade 16*a* of shears 16 is permitted to cut across the full width of groove 18. By contrast, note FIG. 2B where a groove is formed as a rectangular surface and it will be readily evident from inspection that formation of the groove in that manner serves to limit the distance to which blade 16*a* can extend across the groove. In short, the tip of blade 16*a* will not be permitted to cut down into the rectangular shaped groove whenever the tip of blade 16*a* is blocked by the top edge of the groove.

In order to provide a serrated edge to the hair being cut, it is required that the shears be operated in something of a saw tooth style with successive cuts overlying each other if desired, as shown in FIGS. 2C and 2D. Accordingly, the first cut with the shears is identified by the number 1 in FIG. 2C and successive cuts are shown along the successive phantom lines identified by 2, 3, 4, 5 and 6. In FIG. 2D, there is shown diagrammatically, and in quite enlarged detail, the advantage of serrating the ends of the hair in that it provides a certain unevenness in the length of the various hairs so that they do not all end at the same place and provide a relatively blunt edge.

Finally, it is quite important that the centerline 15 be established as close to vertical as possible, and for this purpose, back panel 13 carries a small carpenter's level 19 employing a bubble secured by known means to the lower edge of template 10. In this manner, by examining the condition of the bubble in level 19 from time to time, the barber can determine accurately whether or not the centerline 15 is remaining substantially vertical.

Means for retaining template 10 in a substantially fixed position mounted upon the person whose hair is being cut include the flexible strap 21 of plastic material or otherwise which can, for example, cooperate with a hook and loop attachment pad 22 for retaining the collar portion closed.

As is known, many people carry one shoulder lower than the other. Accordingly, means have been provided for leveling template 10 and orienting centerline 15 in substantially a vertical orientation as now to be described.

Accordingly, a pair of straps 23 are each secured at one end to the underside of back panel 13 of template 10 and these straps are led over the shoulders of the person wearing template 10.

Straps 23 are formed of plastic or the like and include a series of detents or notches 24 whereby, as the free ends of straps 23 are fed through slots 26 formed in the leading edge margin of shoulder portions 11, the straps 23 will be retained in place. This arrangement provides a readily releasable and readily adjustable means for shortening or lengthening the span of each strap 23 defined between slots 26 and the attached end of the particular strap. In order to release the strap from its associated slot 26, it is necessary merely to press down on the relatively thin outer lip 27 so as to enlarge the thickness of slot 26 thereby permitting strap 23 to be withdrawn. It is readily evident that strap 23 can be pulled outwardly through slot 26 without any manipulation due to the inclined leading edge and surface of detents 24.

According to the foregoing and as demonstrated in FIG. 5, the left shoulder 28 of the person whose hair is to be cut is lower than the right shoulder 29. Accordingly strap 23 which passes over the left shoulder 28 has been pulled further ghrough its associated slot 26 so as to shorten the span of strap 23 extending between slot 26 and the attached end of strap 23 as compared to the other strap.

According to another embodiment, a hair-cutting guide template including predetermined patterns, such as grooves 18 noted above, and including the fine hair-restraining grooves 17 has been provided in a manner whereby leveling of the shoulders of the template is accomplished by establishing a coaxial relationship between the collar of the template and the general cylindrical nature of the neck of the person whose hair 20 is being cut. This action also disposes centerline 37 to a vertical orientation (unless the person's neck is not vertical).

Figure 8:
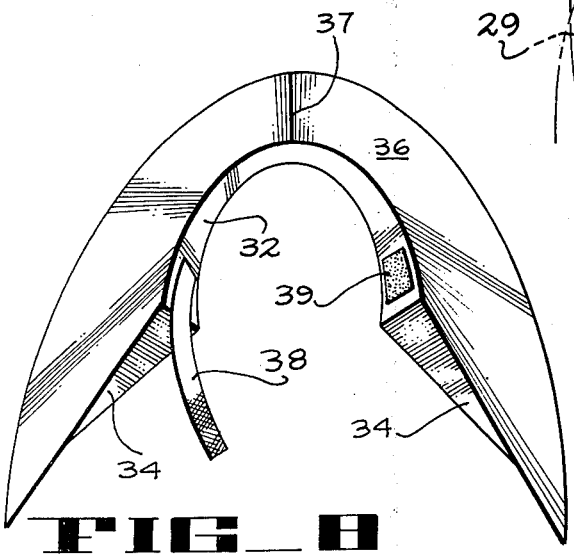
FIG. 8 shows the embodiment of FIG. 7 prior to being positioned on the person whose hair is to be cut.

Accordingly, template 30 in its relaxed condition (FIG. 8) comprises an annular frusto-conical template of semi-rigid material formed to drape over the shoulders and extend across the back of a person. The template is open to that side thereof adapted to be disposed in front of the wearer. Accordingly, template 30 is not a complete annulus but is substantially annular to the extent that only the relieved portion in front of the person whose hair is being cut has been removed. Thus, this part of the template is open and adapted to be disposed in front of the wearer.

Template 30 includes a central collar opening 31 bounded by a downwardly and inwardly slanting inner edge margin 32. The open side of template 30 includes downwardly divergent edges 33 extending from opening 31. A rib 34 is secured to each edge 33 in a position generally normal thereto for providing rigidity to edge 33. The slope of margin 32 becomes progressively more vertical in response to drawing edges 33 together by means of strap 38 so as ultimately to dispose margin 32 substantially coaxial to the generally cylindrical nature of the neck of the wearer.

Figure 10:
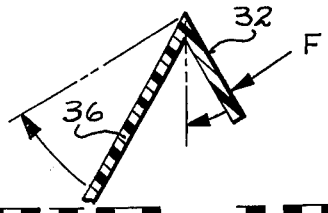
FIG. 10 shows an enlarged detail section view of FIG. 7 taken along the line 10—10.
Figure 7:
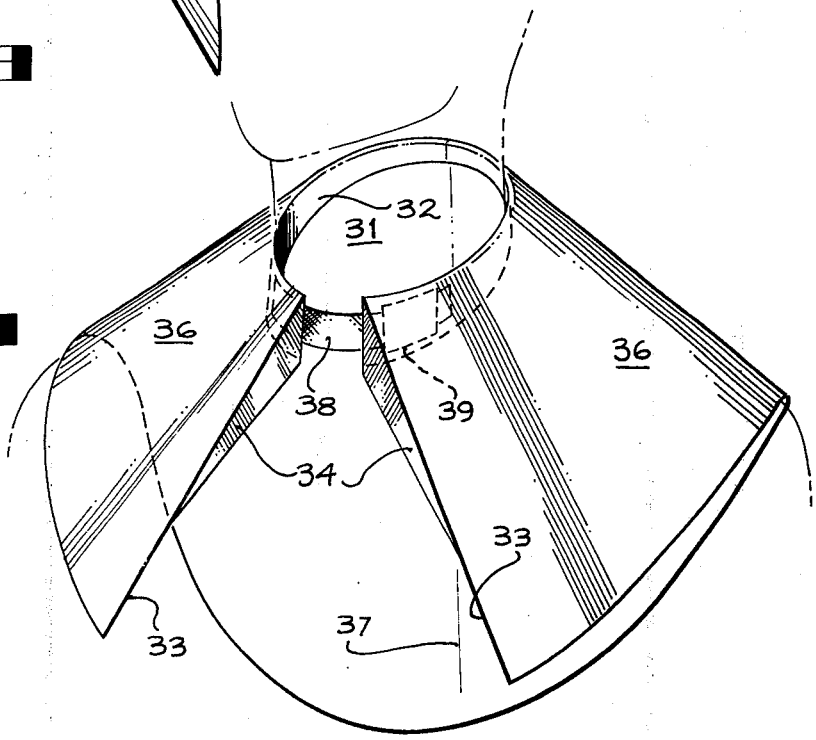
FIG. 7 shows a front perspective schematic view of another embodiment, according to the invention, as worn by a person.
Figure 9:
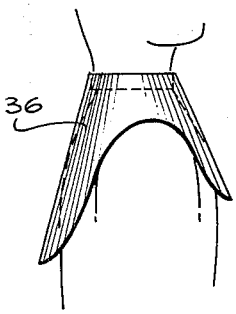

The shoulder portions 36 move evenly upwardly together as edges 33 are drawn together to provide vertical orientation of centerline 37. Thus, a force F acting against margin 32 serves to directly lift the shoulder panel 36 (FIG. 10). Edge margin 32 is wider near the front of template 30 and becomes narrower near the back so as to conform to the physical shape of the human neck.

Finally, means for retaining edges 33 sufficiently together to maintain edge margin 32 in a substantially vertical orientation about the neck of a person includes the pliable plastic strap 38 attached at one end to the inside of margin 32 and at the other end to a hook and loop pad 39 of known construction carried by margin 32.

From inspection, it will be readily evident that the surface of margin 32 is continuous with the surface of ribs 34 so that as edges 33 are drawn together, surface 32 will be forced downwardly to approach a vertical orientation.

Further, when edges 33 are drawn together and margin 32 bends downwardly, the back panel of template 30 tends to become substantially flattened across the back of the wearer and this position of the back panel has the advantage that the hair will be free to take its normal position.

It has been observed that, by restraining lateral movement of the strands of hair which make up the layer of hair lying contiguous to the template, subsequent overlying layers of hair will also be restrained in view of the fact that the hair of the various layers overlying each other on the template is mutually engaged much as a stack of cord wood is mutually engaged to retain lateral movement at all levels.

1. A device for use in cutting long hair to an even length on opposite sides of a substantially vertical centerline defined to extend downwardly between the shoulders of a person, said device comprising a template of semi-rigid material formed to provide a broad surface including shoulder portions adapted to be draped over the shoulders and a back panel portion adapted to extend across the back of a person, said template including a collar portion open at one side to be yieldingly spread apart and disposed about the neck of the person for holding the template in place, said shoulder portions and said back panel portion merging with said collar portion all as a substantially continuous surface, a sufficient number of fine grooves formed to extend downwardly and laterally away from the neck portion on both sides of said centerline to inhibit lateral movement of strands of the hair in the contiguous layer of hair laid thereon, the depth of said grooves being sufficient to engage said strands to be restrained from lateral movement across said surface, and a predetermined pattern of hair length defined on the surface of said back panel for guiding scissors of the barber in cutting the hair to conform to said pattern.

2. A device according to claim 1 in which said pattern is defined by V-shaped grooves formed into the surface of said template, the walls of said grooves diverging from each other at an angle sufficient to permit one tip of a pair of barber's shears to lie alongside one side of the groove with the tip thereof disposed at the apex of the "V" while the other tip of the shears moves freely to a closed position with the first named tip.

3. A device according to claim 1 comprising a line of weakness formed in said back panel and serving to define said centerline, said line of weakness comprising a groove serving to permit said back panel to be resiliently hinged therealong so as to open said collar portion sufficiently to permit mounting of said device about the neck of the wearer and onto the shoulders thereof.

4. A device according to claim 1 further including means disposed on said centerline serving to indicate orientation thereof so as to visually determine when said centerline extends vertically.

5. A device according to claim 1 further including adjustable strap means disposed beneath said shoulder portions and extending across each shoulder of the wearer, said means serving to independently space each shoulder portion from an associated shoulder of the wearer so as to level the shoulder portions.

6. In a device for use in cutting the length of a person's hair to a predetermined pattern evenly on opposite sides of an upstanding centerline defined to extend downwardly between the shoulders of a person, said device comprising an annular frusto-conical template of semi-rigid material formed to drape over the shoulders of and extend across the back of a person, said template being open to that side thereof adapted to be disposed in front of the wearer, said template including a central opening bounded by a downwardly and radially inwardly slanting inner edge margin, the open side of said template including downwardly divergent edges extending from said central opening, a rib secured to each said edge and normal thereto for providing rigidity to same, the slope of said margin becoming progressively more vertical in response to drawing said edges together, said shoulder portions moving evenly upwardly together as said edges are drawn together to provide vertical orientation of said centerline notwithstanding uneven shoulder positions of the person, and means for retaining said edges sufficiently together to maintain said edge margin in a substantially vertical orientation as a collar about the neck of the person.

* * * * *